United States Patent [19]

Russell et al.

[11] 4,198,847

[45] Apr. 22, 1980

[54] BASE FOR A HYDRAULICALLY OPERATED TOOL

[75] Inventors: H. Vernon Russell, Perkasie; Jeffrey V. Russell, Quakertown, both of Pa.

[73] Assignee: Applied Power Inc., Brookfield, Wis.

[21] Appl. No.: 833,499

[22] Filed: Sep. 15, 1977

[51] Int. Cl.[2] ..... B21D 1/12

[52] U.S. Cl. ..... 72/462; 72/705

[58] Field of Search ..... 72/705, 462

[56] References Cited

U.S. PATENT DOCUMENTS

| | | | |
|---|---|---|---|
| 2,010,713 | 8/1935 | Countryman | 72/705 X |
| 2,596,976 | 5/1952 | Barber | 72/705 X |
| 3,088,513 | 5/1963 | Marquardt | 72/705 X |
| 3,252,681 | 5/1966 | Watts | 72/705 X |
| 3,457,767 | 7/1969 | Surber | 72/705 X |
| 3,581,547 | 6/1971 | Estigarribia | 72/705 X |
| 3,590,623 | 7/1971 | Hunnicutt et al. | 72/705 X |
| 3,623,353 | 11/1971 | Dinerman | 72/705 X |
| 3,754,427 | 8/1973 | Hunnicutt | 72/705 X |
| 3,869,767 | 3/1975 | Hunnicutt et al. | 72/705 X |
| 3,906,777 | 9/1975 | Dickens | 72/705 X |
| 4,003,239 | 1/1977 | Step | 72/705 X |
| 4,055,061 | 10/1977 | Bayorgeon | 72/705 X |
| 4,057,994 | 11/1977 | Wolgast et al. | 72/705 X |
| 4,070,834 | 1/1978 | Jameson | 72/705 X |
| 4,088,006 | 5/1978 | Patton | 72/705 X |

FOREIGN PATENT DOCUMENTS

| | | | |
|---|---|---|---|
| 1332498 | 10/1973 | United Kingdom | 72/705 |
| 1443382 | 7/1976 | United Kingdom | 72/705 |

*Primary Examiner*—Milton S. Mehr
*Assistant Examiner*—D. M. Gurley

[57] ABSTRACT

A support for a tool used to straighten the metal portions of a vehicle supported on a support floor. The tool includes a chain adapted to engage the vehicle and the support floor and a hydraulically actuated cylinder having an extensible plunger adapted to engage the chain intermediate its ends. The other end of the cylinder is mounted on a base for pivotal movement about an axis substantially parallel to a support floor. The base has a bottom surface for engaging the support floor and a pin extending perpendicularly from the bottom surface and adapted to be received in a complimentary hole in the support floor.

5 Claims, 9 Drawing Figures

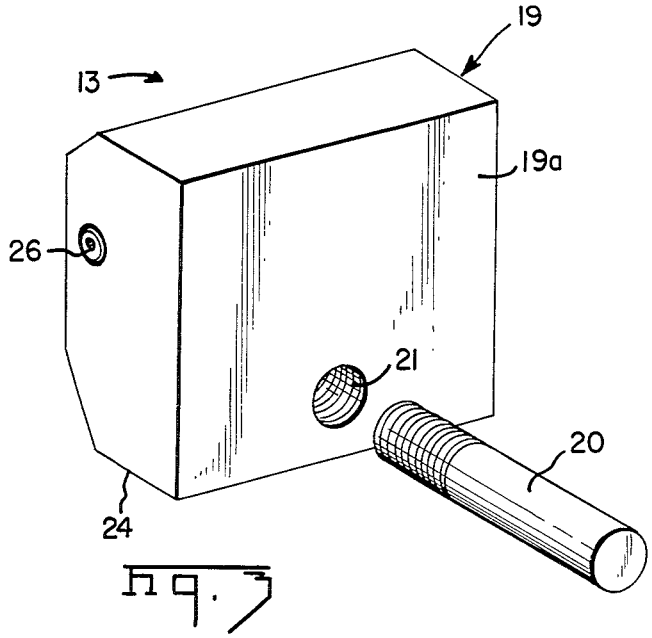
Fig. 3
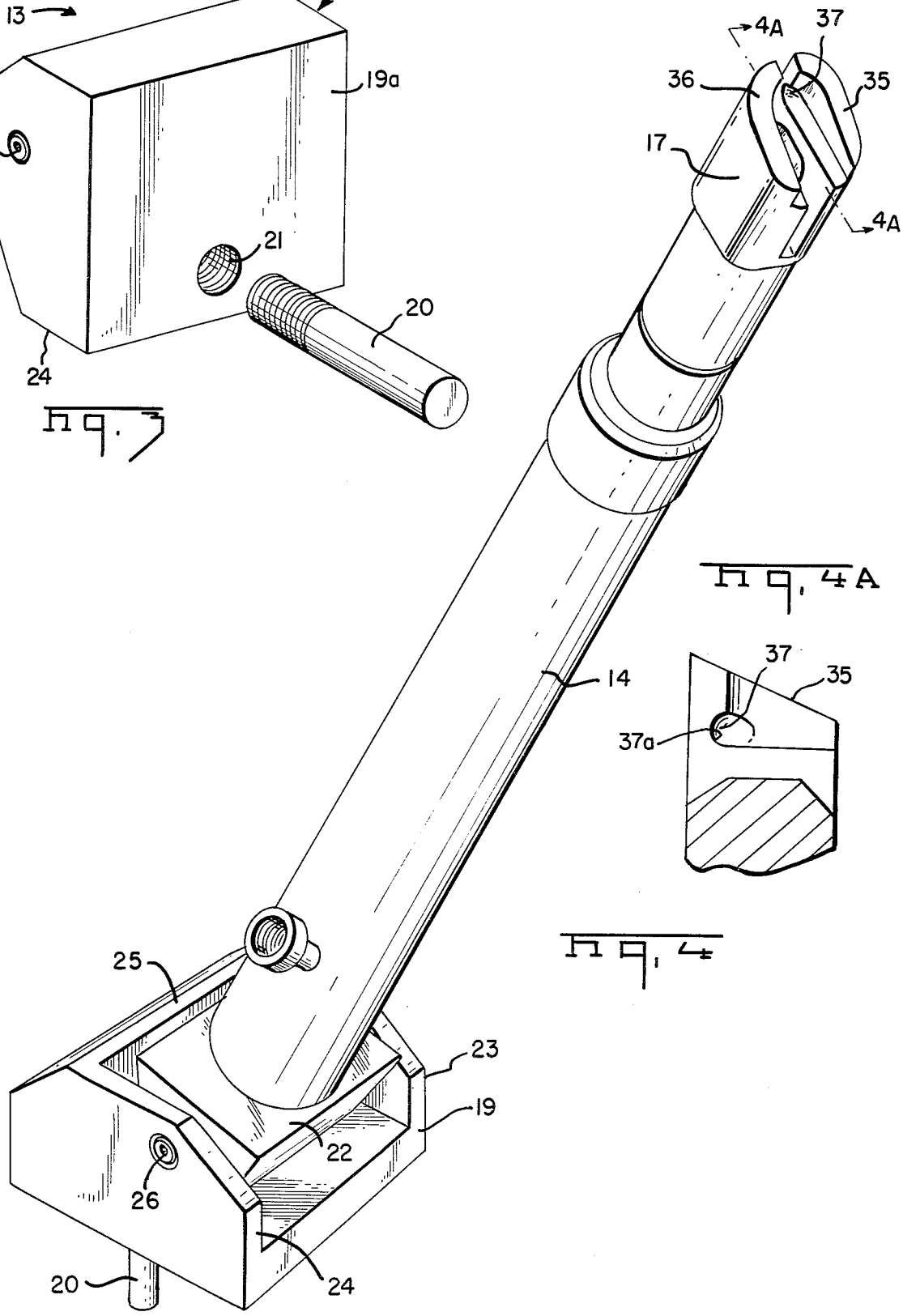
Fig. 4A
Fig. 4

BASE FOR A HYDRAULICALLY OPERATED TOOL

BACKGROUND OF THE INVENTION

This invention relates to hydraulically actuated tools and more particularly to an improved base for a tool used for metal bending.

It has long been desired to avoid the use of hammer applied force for straightening bent metal members. Hydraulic rams have been successfully used for such work. These tools exert extremely high forces on the member to be straightened but a reaction force must be absorbed. Typically, the prior art provides a frame which is permanently installed in or on the structure, e.g., the auto body repair shop, in which the work is performed. Permanent installation of such equipment limits the usefulness of the structure for performing other work. Only metal bending can be performed in places where this equipment is installed.

One approach to providing a portable hydraulic actuated tool which can be easily connected and disconnected from the floor of the structure is shown in U.S. Pat. Nos. 3,590,623, 3,754,427 and 3,869,767-Hunnicutt et al. In these patents, a steel frame is permanently embedded in concrete on the floor of the structure. A base can be secured to this frame. The base has a ball and socket joint for pivoting and rotating the hydraulic ram. The hydraulic ram can be rotated or pivoted to any position desired to apply force to a chain secured to the member to be straightened.

Such systems have been successfully used. However, the cost of the steel frame and its installation in a concrete shop floor is relatively high.

It is an object of the present invention to provide hydraulically operated metal reforming equipment which is economical and safe to operate.

SUMMARY OF THE INVENTION

In accordance with this invention, all of the force of hydraulic metal bending equipment is absorbed by the concrete surrounding a hole in the floor into which a pin of the base is inserted. We have found that the power applied by commercially available hydraulic rams will not exceed the compressive strength of properly laid concrete when the force is applied through the base of this invention.

The apparatus according to the invention includes a base for supporting a hydraulically actuated force producing means for movement about an axis generally parallel to a support surface and an elongate member extending from the support surface and adapted to be received within an aperture formed in a support floor engaged by the support surface. The elongate member is preferably normal to the support surface to provide an axis of rotation normal to the pivot axis to provide universal pivotal movement which permits proper positioning of the hydraulic force producing means.

Further in accordance with the invention, a new and improved base can be used with an existing hydraulic ram and related equipment.

The foregoing and other objects, features and advantages of the invention will be better understood from the following more detailed description and appended claims.

DESCRIPTION OF THE DRAWINGS

FIG. 3 shows the bottom of the base with the pin out of the threaded hole into which it fits;

FIG. 4 shows the assembled base and hydraulic ram;

FIG. 4A is a partial section of FIG. 4 showing the slot in which the chain catches;

DESCRIPTION OF THE PREFERRED EMBODIMENT

Figure 1:
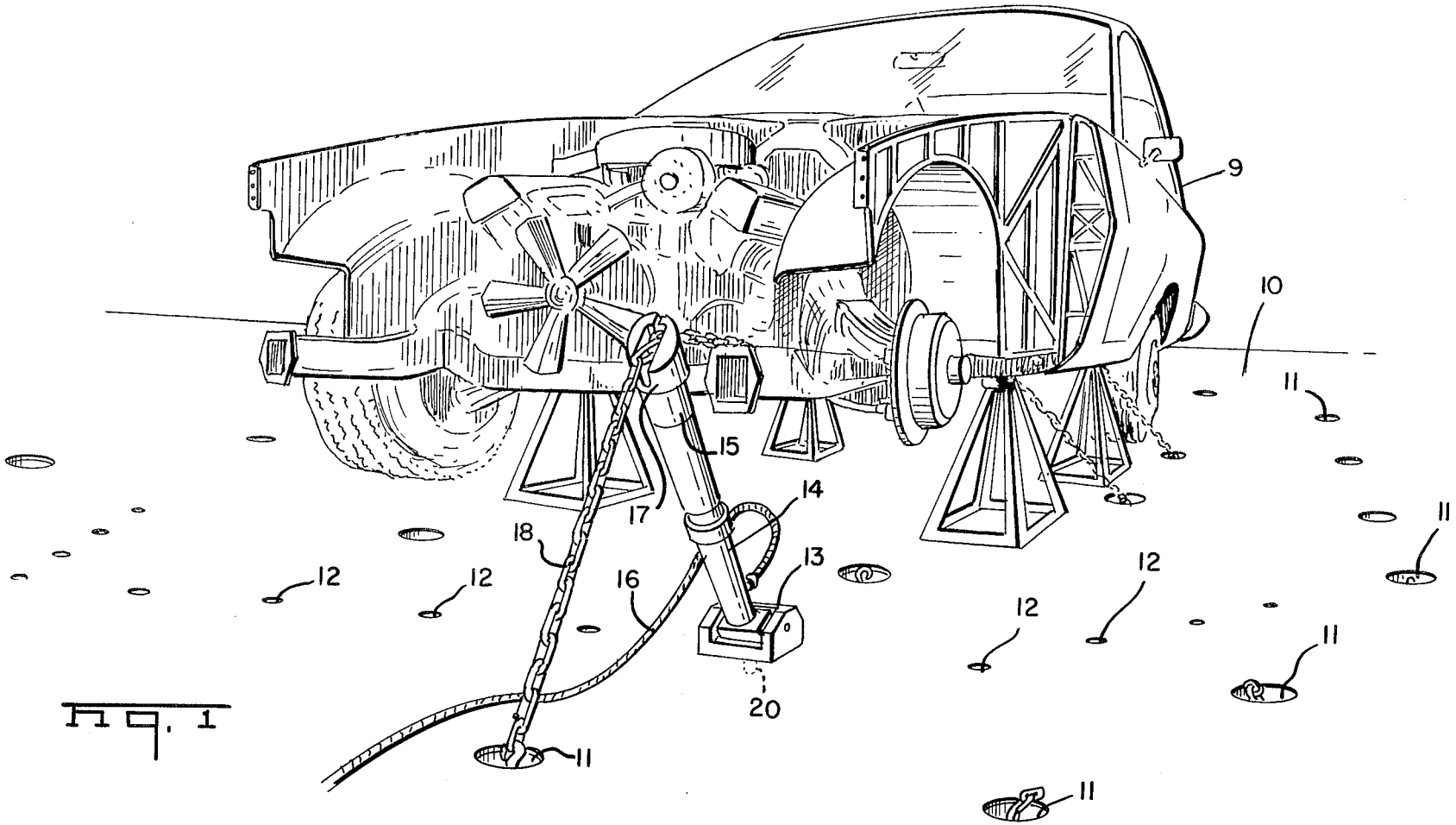
FIG. 1 shows the hydraulically actuated assembly with the improved base of this invention in use.

FIG. 1 illustrates a metal reforming tool with which the support base 13 in accordance with a preferred embodiment of the present invention is used. As those skilled in the art will appreciate, a vehicle 9 being reformed is suitably supported on and anchored to a support floor 10 in a conventional manner. A plurality of anchor pots 11 may be conveniently located at spaced apart points in floor 10 in surrounding relation to the expected position of vehicle 9 with a first group of said pots being located closer to said position than a second group. In addition, a plurality of apertures 12 are formed in floor 10 and arranged generally between the groups of pots 11.

The metal reforming tool includes a hydraulic cylinder 14 which is pivotally connected at its lower end on the support base 13. A head 17 is carried by a plunger projecting from the opposite end of cylinder 14 for engaging the mid-region of an elongate force transmitting member such as a chain 18 which may be anchored at one end in one of the anchor pots 11 while the other end is affixed to the metal portion of the vehicle to be reformed. An extension 15 may be provided between the plunger of cylinder 14 and the head 17. Extending downwardly from the base 13 is a pin 20 adapted to be received within one of the apertures 12 formed in the support floor 10.

Figure 2:
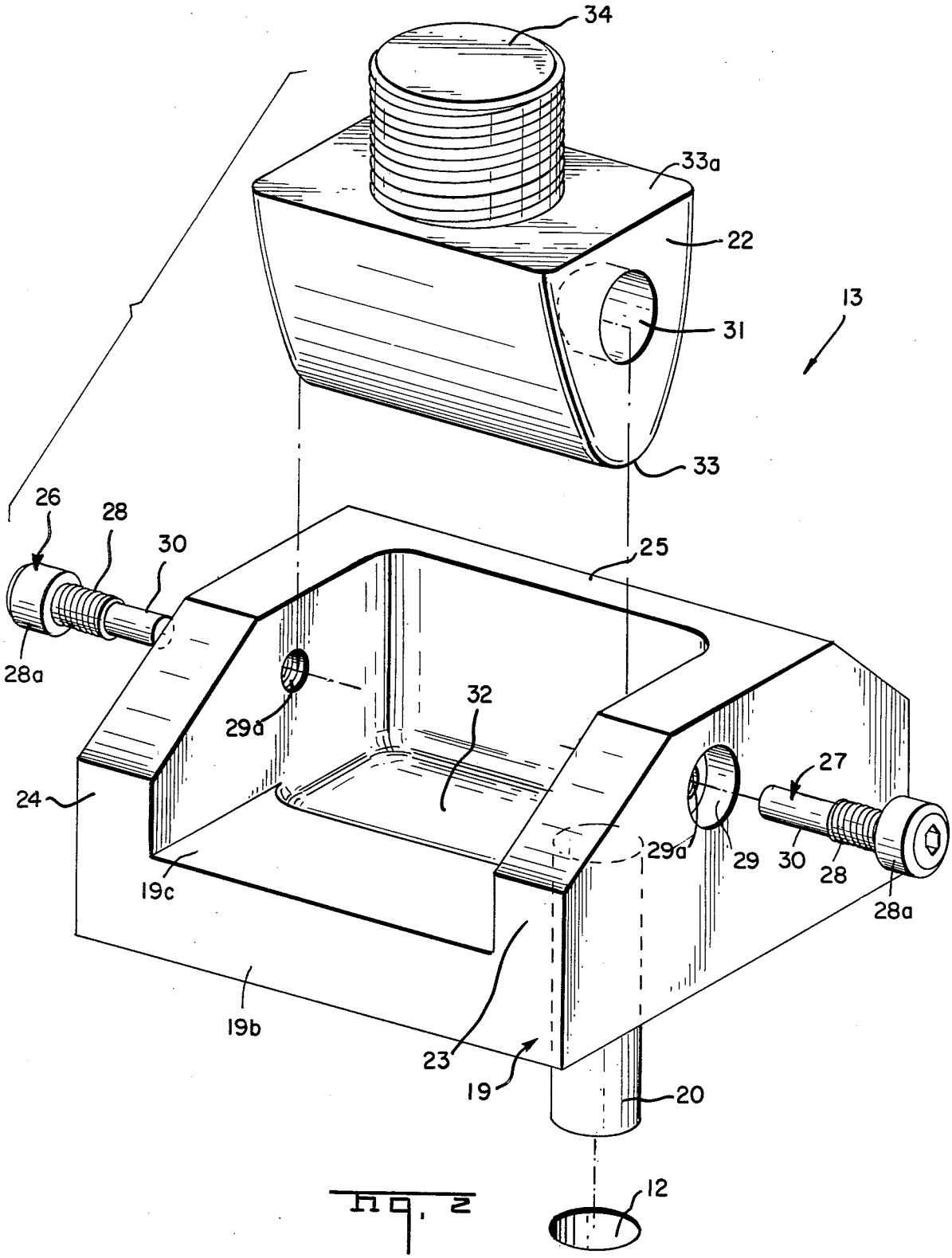
FIG. 2 is a view of the base exploded to show the toe member out of the recess into which it fits.

Referring now to FIGS. 2–4, the base 13 is shown to include a base member 19. A steel pin 20 is suitably secured to the undersurface **19*a* of base member 19. For example, the end of pin 20 may be threaded for being received into a complimentary threaded opening 21 formed in the lower surface 19*a*. A pivot member 22 is suitably secured to the end of hydraulic cylinder 14 for pivotally connecting the same to the base 19. Specifically, base 19 has a horizontally extending central portion 19*b* and opposed vertical end walls 23 and 24. A third vertical wall 25 extends upwardly from central portion 19*b* and bridges the end walls 23 and 24. A pair of pivot pins 26 and 27 extend through coaxial apertures 29 formed in end walls 23 and 24, respectively, and into apertures 31 formed in the sides of pivot member 22. The pins 26 and 27 each have a head 28*a* at one end and an intermediate threaded portion 28 for engaging internal threads 29*a* formed in a reduced diameter portion of holes 29. The opposite end portion 30 of each pin 26** and 27 is unthreaded and of reduced diameter for being received in apertures 31. The unthreaded portion 30 of each pin 26 and 27 preferably fits loosely in the holes 31 for pivotally supporting and retaining pivot member 22 on base 19.

The upper surface 19*c* of central base portion 19*b* has a concave recess 32 extending horizontally between the vertical end walls 23 and 24 and adjacent the third vertical wall 25. The bottom surface 33 of pivot member 22 is generally hyperbolic in transverse cross section and is received within the concave recess 32 during pivotal movement. Because the outside diameters of the unthreaded portions 30 of pins 26 and 27 are substantially smaller than the internal diameter of the holes 31, the surface 33 will rest in the recess 32 during operation so that the reaction force of the cylinder 14 on the base 13 will be from pivot member 22 to recess 32 rather than the pins 26 and 27. The pins will, therefore, retain the pivot member 22 within the base 13 without being subjected to the high forces involved in metal reforming.

Those skilled in the art will appreciate that the pivot member 22 may be secured to the cylinder 14 in any suitable manner. For example, a threaded stub 34 may be provided on the flat upper surface 33*a* of the pivot member 22 for engaging a suitably threaded hole (not shown) in the end of hydraulic cylinder 14.

Figure 5:
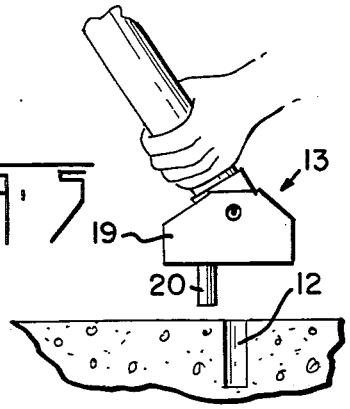
FIG. 5 shows the base with the pin about to be inserted into a hole in the concrete floor.
Figure 6:
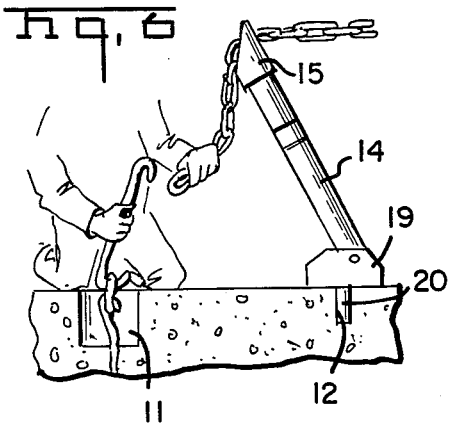
FIG. 6 shows the base with the pin in the concrete floor and the chain about to be attached to an anchor pot.

FIG. 5 shows the pin 20 about to be inserted into a hole 12 in the concrete floor. FIG. 6 shows the base in place with a pin in the hole in the concrete. The pin 20 mates the hole 12 so that all of the force from the hydraulic cylinder 14 is applied to the concrete floor around the periphery of the hole 12. In one working embodiment of the invention, the pin 20 is a ¾"×3" pin made of ¾" stress proof steel, guaranteed min. yield of 100,000 psi. We have found that this steel pin inserted into a mated hole in properly laid concrete is able to absorb all of the force developed by a hydraulic cylinder capable of ten tons of applied power. This includes all presently available commercial hydraulic rams up to ten tons capacity of the type used for auto body and other metal bending uses. The reason that this is possible is that concrete has exceptionally high compressive strength; in fact, for all practical purposes, concrete will not compress. By a properly laid concrete floor, we mean one meeting American Concrete Institute standards of 4000 psi (281 KgF/cm.$^2$).

Steel pin 20 is better able to absorb these forces than bases provided for prior art tools. For example, in U.S. Pat. No. 3,869,767, the "C" shaped clamp 51 transmits the force from the hydraulic ram to the floor. Such a clamp will fail under less force than a pin made of the corresponding amount and type of steel.

FIG. 4 shows the head 17 which includes flanges 35 and 36 and a notch 37 disposed therebetween. In operation, the chain in inserted between flanges 35 and 36 so that one link of the chain 18 catches in the notch 37. As better shown in FIG. 4*a*, the notch 37 has a concave surface 37*a* for accommodating the chain link which typically has a radius of curvature of about ⅜ inch. With the base 13 of this invention, it is not necessary to insert a pin through the head and chain as in the aforementioned patents. Obviating the need for such a pin facilitates setting up the equipment and also eliminates one possible failure point. In the prior art the chain must be pinned in the head while the assembly is being set up or the cylinder may come out of the ball and socket joint if the cylinder falls.

Figure 7:
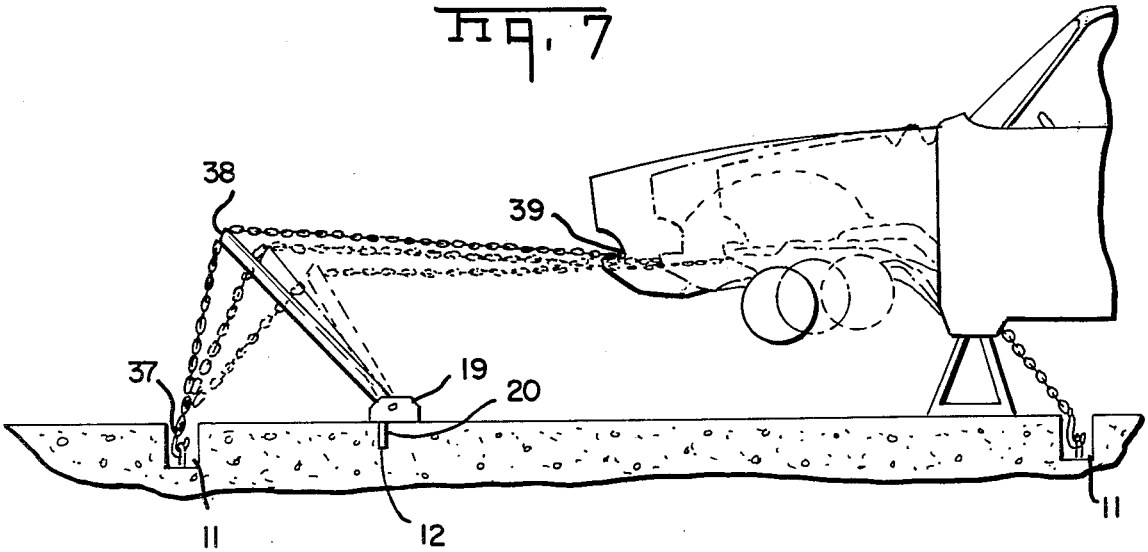
FIG. 7 shows three different pulling angles which can be obtained by the assembly.
Figure 8:
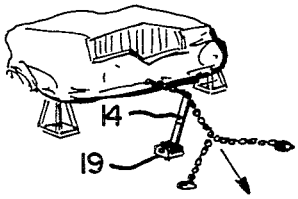
FIG. 8 depicts a split chain which can be used when an anchor pot is not on the line of pulling.

We have found that once the hydraulic cylinder is positioned in a straight pulling line with the chain extending to the part to be straightened and the chain is put under tension, the hydraulic ram and its extension will remain in this position; FIG. 7 depicts how a plurality of different pulling angles can be utilized from an initial position of the base 19 in pin 20. Once the slack in the chain is taken up, there is no movement in the chain at point 37 and only slight movement at points 38 and 39. Often there is no anchor pot on the straight pulling line. When this occurs a split chain can be used in the manner depicted in FIG. 8.

While a particular embodiment of the invention has been shown and described, various modifications are within the true spirit and scope of the invention, the appended claims are intended to cover all such modifications.

What is claimed is:

1. In a tool assembly adapted to be used on a generally planar support surface having at least one hole, said assembly including a hydraulically actuated device having a plunger which moves outwardly from a cylinder when hydraulic force is applied, the improvement comprising:

a base having a generally planar bottom surface adapted to slidably engage the support surface and including front and rear end portions, first means for pivotally connecting said base to said hydraulic cylinder, and a single pivot pin extending generally perpendicularly from the bottom surface of said base and adapted for extending downwardly into said hole in said support surface, said pin being engageable with the periphery of said hole for pivotal movement about an axis generally perpendicular to said bottom and support surfaces, said base having a concave upwardly facing surface, said first means having a convex surface engageable with the concave surface on said base for transferring the reaction forces thereto, said first means being connected to said base for pivotal movement about an axis substantially parallel to the bottom surface, the axis of said pivot pin being offset laterally from the pivot axis of said first means.

the engagement between said bottom and support surfaces applying forces generated by said hydraulic cylinder from said bottom surface to said support surface and around the periphery of said hole.

2. The tool recited in claim 1 wherein said base includes a central portion and opposed side walls extending substantially vertically from said central portion, and pivot means mounted on said side walls and extending along the pivot axis of said first means and engaging said first means for pivotally supporting the same.

3. The tool recited in claim 2 wherein said side walls have aligned threaded apertures and said first means has a pair of aligned holes in the opposite sides thereof, first and second pin means having threaded and unthreaded portions with the threaded portion of each being disposed in one of said apertures, the unthreaded portion of each pin means being received in one of the holes in said first means.

4. The tool recited in claim 3 wherein the internal diameter of the holes in said first means are larger than the external diameter of the unthreaded end portions of said pin means whereby the reaction forces between said first means and said base are carried by said convex and concave surfaces.

5. The tool recited in claim 1 and including pin means mounted on one of said base and first means and apertures formed on the other of said base and first means for pivotally mounting said first means on said base, said pin means extending along the pivot axis of said first means and being received in said apertures, the outside diameter of said pin means being smaller than the inner diameter of said apertures whereby said first means is retained on said base without said pin means bearing reaction forces of said hydraulically actuated device.

* * * * *